US005210950A

United States Patent [19]

Rankl

[11] Patent Number: 5,210,950

[45] Date of Patent: May 18, 1993

[54] POCKET OR CLASP KNIFE

[76] Inventor: Christian Rankl, Possenhofenerstr. 33, München 71, Fed. Rep. of Germany, 8000

[21] Appl. No.: 853,398

[22] Filed: Mar. 18, 1992

[30] Foreign Application Priority Data

Mar. 18, 1991 [DE] Fed. Rep. of Germany ..... 9103272

[51] Int. Cl.[5] ..... B26B 3/06

[52] U.S. Cl. ..... 30/161; 30/159; 30/160

[58] Field of Search ..... 30/161, 160, 330, 331, 30/159

[56] References Cited

U.S. PATENT DOCUMENTS

| | | | |
|---|---|---|---|
| 988,068 | 3/1911 | Beardsley et al. | 30/161 |
| 2,327,090 | 8/1943 | Berg | 30/159 |
| 4,535,539 | 8/1985 | Friedman et al. | 30/161 |
| 5,095,624 | 3/1992 | Ennis | 30/159 |
| 5,125,157 | 6/1992 | Howard | 30/161 |

*Primary Examiner*—Douglas D. Watts
*Assistant Examiner*—Hwei-Siu Payer
*Attorney, Agent, or Firm*—Townsend and Townsend

[57] ABSTRACT

A pocket or clasp knife comprises a handle part (11) and a blade part (12). By means of a spring bar (14), which is elastically and pivotably mounted on the handle part (11) and comprises an abutment (16), the blade part (12), which comprises a counter-abutment (17), can be fixed in the extended position. In the region of the pivot axis (15) the spring bar (14) comprises an elongated slot (18) which extends through the spring bar in the direction of the pivot axis (15), with abutment faces (19, 20), fixed with respect to the handle part, being provided in the elongated slot and on opposite edges (21, 22) of the elongated slot (18) in front of and behind the pivot axis (15), such that by manually pivoting the spring bar (14) in order to bring the abutment (16) and the counter-abutment (17) out of contact, the abutment faces (19, 20) elastically spread apart the edges (21, 22) of the elongated slot (18).

6 Claims, 2 Drawing Sheets

POCKET OR CLASP KNIFE

BACKGROUND OF THE INVENTION

The invention relates to a pocket or clasp knife comprising a handle part and a blade part, which is mounted with its rear end at the front end of the handle part for pivoting about a transverse axis, such that the blade part can be selectively extended or pivoted back against the handle part. A spring bar made of spring material, in particular spring steel, extends in the longitudinal direction of the handle part and is mounted in the handle part so as to be manually pivotable against a spring force about a pivot axis which extends preferably parallel to the transverse axis. The spring bar is provided at its front end with an abutment which cooperates with a counter-abutment at the rear end of the blade part in such a manner that when the blade part is extended the abutment is brought by the spring force into contact with the counter-abutment and the blade part is thereby fixed in the extended position, and in such a manner that the abutment and the counter-abutment can be brought out of contact by manually pivoting the spring bar against the spring force.

In such pocket or clasp knives the abutment on the spring bar is generally formed onto a hook part which extends towards the blade part, said hook part extending into a complementary groove of the blade part under a spring force in the region of the transverse axis, such that the blade part, in the extended position where it is axially substantially aligned with the handle part, is fixed in the two pivoting directions. By manually pivoting the spring bar against the spring force, the hook part is then extracted from the groove, whereupon the blade part can then be pivoted back onto the handle part, where in particular the cutting edge is arranged into a slot-shaped accommodating space.

In known pocket or clasp knives of this kind the spring bar is either pivotably mounted about a transverse axis onto the handle part and is urged by a special spring into the engagement position, or the spring bar can also be connected in a form-locked manner to the handle part at the end region remote from the abutment end and pivoted by means of a special lever under elastic deformation, such that the hook part is raised out of the groove of the blade part. In the last case, the spring bar itself must exhibit corresponding elastic properties.

In any case, the spring bar is accommodated into an elongated slot-type depression of the handle part, which lies directly over the slot-type accommodating space for the blade part. The accommodation of the spring bar in the elongated slot-type depression occurs in any case such that the spring bar can describe the required pivoting displacement when it is urged by hand, so that it is movably mounted in a corresponding manner.

While the provision of a special return spring is expensive and requires the preparation of a further part, subject to disturbances, in the form of the spring, in the case of use of the spring bar itself as return springing member, a special lever must be provided for raising the hook part out of the groove.

SUMMARY OF THE INVENTION

The object of the invention is to realize a further pocket or clasp knife of the initially mentioned type. In particular, the pocket or clasp knife of the invention must avoid the requirement of particular spring members or of a particular actuation lever which is additionally articulated.

For solving this problem, the following features are provided:

the spring bar is provided in the region of the pivot axis with an elongated slot which extends through the spring bar in the direction of the pivot axis, with abutment faces, fixed with respect to the handle part, being provided in the elongated slot and on opposite edges of the elongated slot in front of and behind the pivot axis at a significant distance from the end of the elongated slot which is located on this side of the pivot axis, such that by manually pivoting the spring bar in order to bring the abutment and the counter-abutment out of contact, the abutment faces elastically spread apart the edges of the elongated slot.

In this manner, not only the springing properties of the spring bar itself are employed for providing the required springing engagement force, but it is in particular ensured that the pivot axis and the abutment faces can be located comparatively close to the transverse axis of the blade part, such that a relatively long lever arm is still available rearwardly, which lever arm can be also urged directly and conveniently by the user, such that it is possible to avoid intermediate transmission levers.

Owing to a corresponding selection of the axial distance between the abutment faces and of the length of the lever arm, it is practically possible to realize any desired force conversion, such that despite the comparatively important forces which are required for spreading the elongate slot apart, the actuation force which is to be applied manually at the end of the lever remains in the limits which are usual for the actuation of such pocket or clasp knifes.

In a particularly advantageous manner, the spring bar is also held axially, i.e. in its longitudinal direction, by providing broadened regions in the elongated slot, preferably at a distance from its end, said broadened regions being provided with axial abutment faces which face in the longitudinal direction of the spring bar, said axial abutment faces cooperating with abutment faces, fixed with respect to the handle part, and determining the longitudinal direction of the spring bar for each pivotal position.

One advantageous embodiment is characterized in that the abutment faces are provided on an abutment web, fixed with respect to the handle part, which has an elongated cross-section extending substantially in the longitudinal direction of the elongated slot, and is accommodated in one corresponding broadened region of the elongated slot. A further advantageous embodiment is characterized in that the abutment faces are provided on two abutment pins, fixed with respect to the handle part, which are provided on two sides of the pivot axis and are accommodated in corresponding broadened regions of the elongated slot.

According to another feature a rotary guide pin fixed with respect to the handle part is provided between the two abutment pins and at the location of the pivot axis, said rotary guide pin engaging into a corresponding broadened region of the elongated slot and representing a rotary guide for the spring bar. This rotary guide of the spring bar against the handle part simplifies the manufacturing process, since after the mounting of the rotary guide pin on the handle part, while the blade part is extended and the hook part of the non-tensioned spring bar is in engagement into the groove, the blade can be taken away and, before mounting the abutment pins of the spring bar, can be pivoted over a small angle such that the required springing pretension is present for the ensuing introduction of the blade part.

It is important that the abutment faces of the invention are realized on abutment members which also ensure an axial fixation of the spring bar in all pivotal positions.

This can be preferably ensured in that the elongated slot parts provided on both sides of the broadened regions open eccentrically into the broadened regions in such a manner that an axial form-locked engagement provided between the abutment elements in the direction of the elastic engagement is maintained when the elongated slot is spread apart.

DESCRIPTION OF THE PREFERRED EMBODIMENTS

Figure 2:
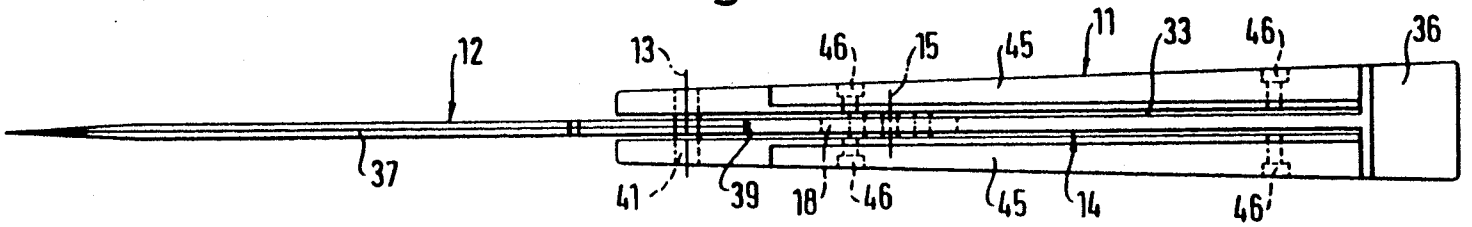
FIG. 2 is a view of the device of FIG. 1, taken in the direction of the arrow II in FIG. 1.
Figure 1:
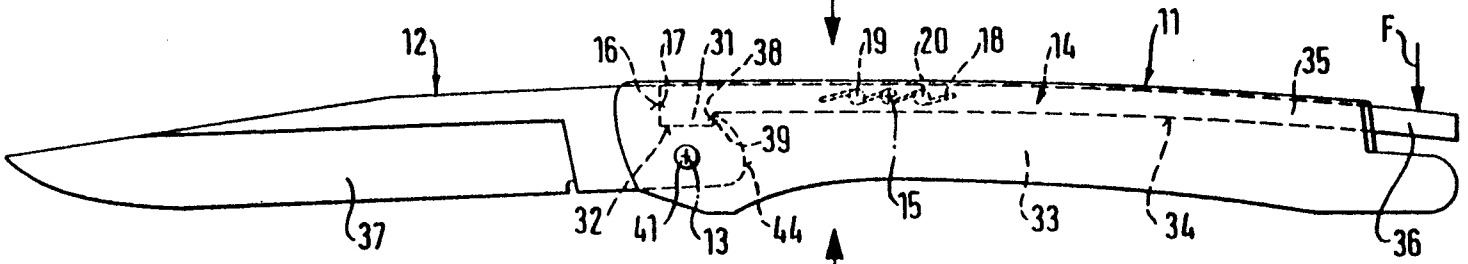
FIG. 1 is a schematic side view of a pocket or clasp knife of the invention, with the blade part in extension.
Figure 3:
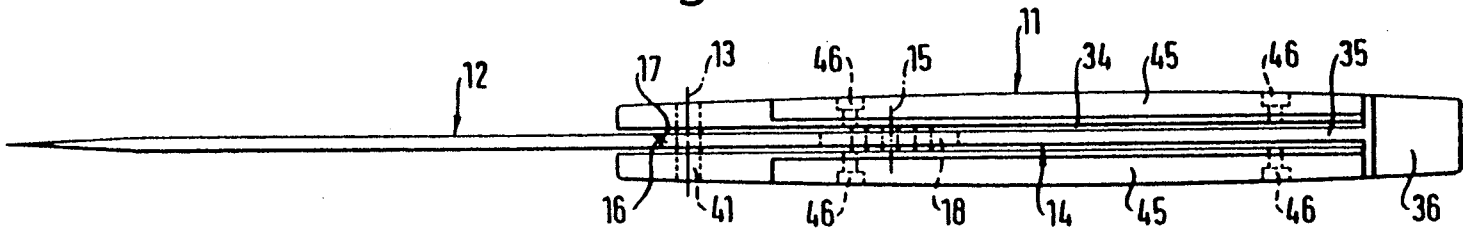
FIG. 3 is a view of the device of FIG. 1, taken in the direction of the arrow III in FIG. 1.

According to FIGS. 1 to 3, the pocket or clasp knife of the invention comprises a handle part 11 and a blade part 12 which is mounted onto the latter for pivoting about a transverse axis 13. A cutting edge 37 is provided on the blade part. In the side of the handle part 11 remote from the cutting edge 37 is provided an elongated slot-type opening 34, in which is guided an elongated spring bar 14 of rectangular-shaped cross-section. However, the spring bar is movably accommodated in the direction of the pivot movements of the blade part 12.

Figure 4:
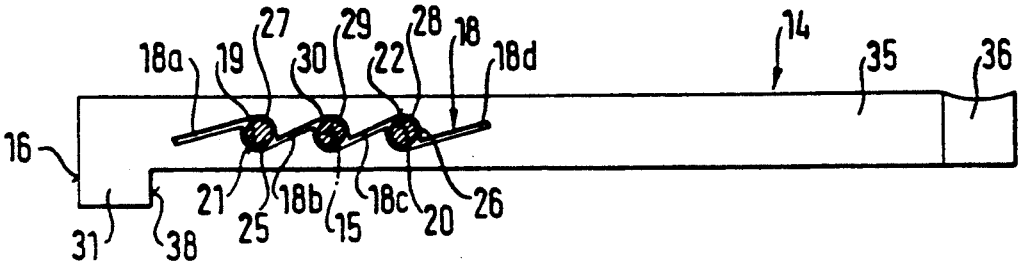
FIG. 4 is a schematic side view of the spring bar of the embodiment of FIGS. 1 to 3 only, which is engaged onto abutment pins and a rotary guide pin.
Figure 4A:
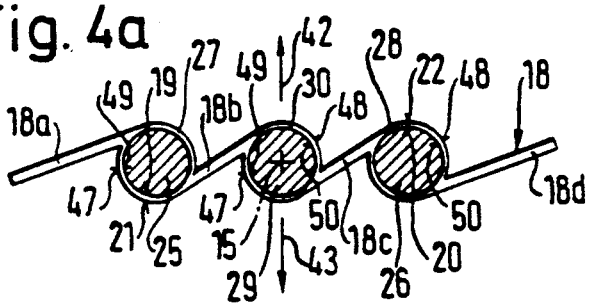
FIG. 4*a* is an enlarged portion of FIG. 4.

As shown in FIGS. 1, 4 and 4*a*, the spring bar is provided with an elongated slot 18 which extends entirely through the spring bar in the direction of the transverse axis 13. The elongated slot 18 must extend substantially only in the longitudinal direction of the handle part 11 or of the spring bar 14 and can somewhat deviate in whole or in part from this longitudinal direction, as it is apparent in FIGS. 1, 4 and 5.

As shown in FIGS. 4 and 4*a*, the elongated slot 18 is preferably located in the half of the spring bar 14 which is directed towards the forward hook part 31. As shown in FIG. 1, the hook part 31 engages into a groove 32 of the blade part, and indeed substantially above the transverse axis 13, such that the hook part 31 describes a movement substantially away from the transverse axis 13 when it is brought out of the groove 32.

The hook part 31 comprises a front abutment 16 and a rear abutment 38, which cooperate with the counter-abutments 17 or 39 of the blade part 12 which are formed by the sides of the groove 32. Owing to the engagement of the hook part 31 into the groove 32, the blade part 12 is fixed in rotation relative to the the handle part 11 in the extended position illustrated in FIGS. 1 to 3. To this end, the spring bar 14 must be held axially sufficiently within the handle part 11 in the manner described hereafter in detail.

As shown in FIGS. 4 and 4*a*, the elongated slot 18 comprises three axially spaced and substantially circle-shaped broadened regions 27, 28, 30, which extend parallel to the transverse axis and are traversed by complementary abutment pins 25, 26 or by one rotary guide pin 29, with said pins being fixed at both ends to the handle part 11.

In this manner, the elongated slot 18 is subdivided into four portions 18*a*, 18*b*, 18*c*, 18*d*, which open at least substantially tangentially in the broadened regions 27, 28, 30, in the manner apparent in FIGS. 4 and 4*a*, such that the spring bar 14 is safely held in the two axial directions by the axial abutment faces 47, 48 thus formed on the spring bar 14 and the counter-abutment faces 49, 50 on the pins 25, 26, 29 even in the spread-apart condition, such that a trouble-free and safe fixation of the blade part 12 in the extended position of FIG. 1 is ensured.

Owing to the described arrangement a comparatively long actuation lever arm 35 is available on the side of the spring bar 14 remote from the hook part 31, and this lever arm can be prolonged by an actuation part 36 which is for example adapted to the form of the fingers and projects outwardly from the handle part 11.

The assembly of the pocket or clasp knife of the invention occurs as follows:

firstly the blade part 12 is mounted on the handle part 11 together with the spring bar 14 by mounting a pin 41 in the region of the pivot axis 13 and only the rotary guide pin 29 in the broadened region 30, and in fact in the engagement position of the hook part 31 and the groove 32 shown in FIGS. 1 to 3. Here the spring bar 14 is not yet tensioned in a springing manner.

Thereafter, the blade part 12 is removed by extracting the pin 41 and the spring bar 14 is thereafter somewhat pivoted about the pivot axis 15 which coincides with the axis of the rotary guide pin 29 in the counter-clockwise direction in FIGS. 1 and 4. Thereafter, the bores for the abutment pins 25, 26 are pierced and the abutment pins 25, 26 are introduced into the broadened regions 27, 28 and secured on the handle part 11.

The spring bar 14 is now pivoted in the clockwise direction in FIG. 1, by exerting a pressure in the direction of the arrow F onto the actuation part 36, such that the borders 21, 22 of the elongated slot 18 come into contact with the corresponding abutment faces 19, 20 of the abutment pins 25, 26 as shown in FIGS. 1, 4 and 4*a*, whereupon the elongated slot 18 is elastically spread apart in the direction of the arrows 42, 43 in FIG. 4*a*. Owing to the shell-like realization of the axial abutment faces 47, 48 the axial form-locked holding of the spring bar 14 on the handle part 11 is maintained.

The blade part 12 can now be mounted on the handle part 11 by means of the pin 41. If the spring bar 14 is thereafter released, the elongated slot 18 is again brought back in its non-spread condition by virtue of the elastic return forces, such that the hook part 31 either falls into the groove 32 in the extended position of FIG. 1, or is resiliently supported on a cam track 44 which is provided at the end of the blade part 12 and opens in the groove 32. Owing to the assembly of the invention, the elongated slot 18 can however no longer return completely to its non-spread condition, in the snapped position of the hook part 31 into the groove 32 shown in FIG. 1, such that there remains a certain elastic snapping force also in the extended condition of the blade part 12.

The pocket or clasp knife is then ready for use.

If it is to be folded from the position illustrated in FIG. 1, one exerts a force onto the spring bar 14 relative to the handle part 11 in the direction of the arrow F, whereafter the spring bar 14 is pivoted in the clockwise direction about the pivot axis 15 while the elongated slot 18 is spread apart and the hook part 31 is raised out of the groove 32. Thereafter the blade part 12 can be folded back, and the hook part 31 elastically slides along the supporting cam 44, once the force F is again suppressed, until the cutting edge 37 has entered the slot-like accommodation space 33 provided for it in the handle part 11. The pocket or clasp knife occupies then the completely folded position.

Figure 5:
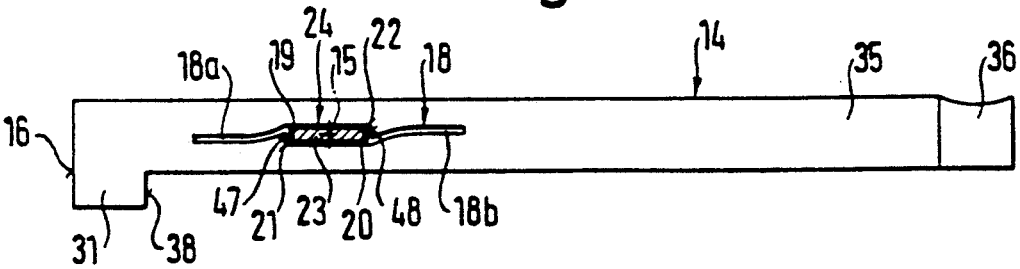
FIG. 5 is a view similar to that of FIG. 4 of a further embodiment of a spring bar of the invention, which cooperates with an abutment web.
Figure 5A:
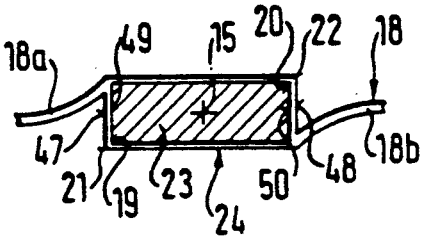
FIG. 5*a* is an enlarged portion of FIG. 5.

In the embodiment of FIGS. 5 and 5*a*, instead of the two abutment pins 25, 26, provision is made for an abutment web 23, fixed with respect to the handle part, which has an elongated cross-section extending in the longitudinal direction of the spring bar 14 and which is accommodated in a complementary broadened region 24 of the elongated slot 18. Owing to this the elongated slot 18 is subdivided into two portions 18*a*, 18*b*, which open in turn at the upper or lower end of the broadened region in such a manner that also in the spread-apart condition of the elongated slot 18 the abutment web 28 remains connected in a form-locked manner in the axial direction to the spring bar 14, and to this effect axial abutment faces 47, 48 are available on the spring bar 14 and counter-abutment faces 49, 50 are available on the abutment web 23.

In the embodiment of FIGS. 5 and 5*a*, the abutment faces 19, 20 are provided at the lower surface of the abutment web 23 completely on the left in FIGS. 5 and 5*a*, or at its upper surface completely on the right. On pivoting the spring bar 14 in the clockwise direction about the centrally provided pivot axis 15, they cooperate at this place with the oppositely-lying borders 21, 22 of the broadened region 24 of the elongated slot 18.

It is important that, starting from the abutment faces 19, 20, the elongated slot 18 still extends on both sides over a significant portion within the spring bar 14. The axial distance of the abutment faces 19, 20 is preferably about 10 to 30, in particular about 20% of the total length of the elongated slot 18. In absolute terms, the axial distance between the abutment faces 19, 20 is about 1 cm, whereas the total length of the elongated slot 18 is about 4 to 6, and in particular about 5 cm.

The thickness of the spring bar 14 corresponds to that of the spring bar of a usual pocket or clasp knife and is about 2 to 3 mm.

The handle part 11 is substantially made of metal, but provision can be made of inserts 45 of plastics or wood (FIGS. 2, 3), which are secured on the handle part 11 by means of screws 46.

For the sake of clarity, a gap is shown in FIGS. 4, 4*a*, 5, 5*a* between the components 23, 25, 26, 29 on the hand and the surrounding borders of the elongated slot 18 on the other hand, but in the reality this gap can be absent since the upper and lower borders can preferably contact the considered components under pressure, and the front and rear borders can preferably contact these components without pressure.

What is claimed is:

1. A foldable pocket knife comprising a handle part (11) and a blade part (12), which is mounted with its rear end at a front end of the handle part (11) for pivoting about a transverse axis (13), such that the blade part can be selectively extended or pivoted back against the handle part (11), with a spring bar (14) made of spring material which extends in a longitudinal direction of the handle part being mounted in the handle part so as to be manually pivotable against a spring force about a pivot axis (15) which extends parallel to the transverse axis (13), said spring bar being provided at its front end with an abutment (16) which cooperates with a counter-abutment (17) at a rear end of the blade part (12) in such a manner that when the blade part (12) is extended the abutment (16) is brought by the spring force into contact with the counter-abutment (17) and the blade part (12) is thereby fixed in the extended position, and in such a manner that the abutment (16) and the counter-abutment (17) can be brought out of contact by manually pivoting the spring bar (14) against the spring force, wherein the spring bar (14) is provided in a region of the pivot axis (15) with an elongated slot (18) which extends through the spring bar in a direction of the pivot axis (15), with abutment faces (19, 20), fixed with respect to the handle part, being provided in the elongated slot and on opposite edges (21, 22) of the elongated slot (18) in front of and behind the pivot axis (15) and spaced from an end of the elongated slot (18) location on a side of the pivot axis (15) such that by manually pivoting the spring bar (14) in order to bring the abutment (16) and the counter-abutment (17) out of contact, the abutment faces (19, 20) elastically spread apart the edges (21, 22) of the elongated slot (18).

2. The foldable pocket knife according to claim 1, wherein broadened regions (24, 27, 28, 30) are provided in the elongated slot (18) and spaced from its end, said broadened regions forming axial abutment faces (47, 48) which face in the longitudinal direction of the spring bar (14), and including means for forming abutment faces (49, 50) which are fixed with respect to the handle part, cooperate with said axial abutment faces and determine the longitudinal position of the spring bar (14) for each pivotal position.

3. The foldable pocket knife according to claim 1, wherein the abutment faces (19, 20) are provided on an abutment web (23), fixed with respect to the handle part, which has an elongated cross section extending substantially in the longitudinal direction of the elongated slot (18), and is accommodated in a corresponding broadened region (24) of the elongated slot (18).

4. The foldable pocket knife according to claim 1, wherein the abutment faces (19, 20) are provided on two abutment pins (25, 26), fixed with respect to the handle part, with the pivot axis (15) located therebetween and accommodated in corresponding broadened regions (27, 28) of the elongated slot.

5. The foldable pocket knife according to claim 4, wherein a rotary guide pin (29) fixed with respect to the handle part is provided between the two abutment pins (25, 26) and at the location of the pivot axis (15), said rotary guide pin engaging into a corresponding broadened region (30) of the elongated slot (18) and representing a rotary guide for the spring bar (14).

6. The foldable pocket knife according to claim 4, wherein elongated slot parts (18*a*, 18*b*, 18*c*, 18*d*) are provided on both sides of the broadened regions 27, 28, 30) and open eccentrically into the broadened regions (27, 28, 30) in such a manner that an axial form-locked engagement provided between the abutment pins (25, 26) is maintained when the elongated slot (18) is spread apart.

* * * * *